US006193581B1

(12) United States Patent
Wiggs et al.

(10) Patent No.: US 6,193,581 B1
(45) Date of Patent: Feb. 27, 2001

(54) TOY WITH MOVING PARTS

(75) Inventors: Christopher Charles Wiggs; Christopher Joseph Crabtree Taylor, both of London (GB)

(73) Assignee: Origin Products Ltd., London (GB)

( * ) Notice: Subject to any disclaimer, the term of this patent is extended or adjusted under 35 U.S.C. 154(b) by 0 days.

(21) Appl. No.: 09/313,496

(22) Filed: May 17, 1999

Related U.S. Application Data

(63) Continuation of application No. 08/899,175, filed on Jul. 23, 1997, now abandoned.

(30) Foreign Application Priority Data

Jul. 24, 1996 (GB) ..... 9615506

(51) Int. Cl.[7] ..... A12H 3/20; A12H 33/26

(52) U.S. Cl. ..... 446/330; 446/134; 446/136

(58) Field of Search ..... 446/330, 332, 446/352, 357, 358, 444, 134, 135, 137, 138, 139

(56) References Cited

U.S. PATENT DOCUMENTS

| | | | | |
|---|---|---|---|---|
| 2,138,367 | * | 11/1938 | Bonanno | 446/358 |
| 3,582,077 | * | 6/1971 | Parker | 446/332 |
| 3,638,357 | * | 2/1972 | Groh | 446/136 X |
| 3,946,520 | * | 3/1976 | Goldfarb et al. | 446/135 |
| 4,045,908 | * | 9/1977 | Ensmann et al. | 446/441 |
| 4,189,864 | * | 2/1980 | Saito | 446/471 X |
| 4,344,243 | * | 8/1982 | Reszka | 446/83 X |
| 4,493,669 | | 1/1985 | Neuhierl . | |
| 4,834,371 | * | 5/1989 | Hay et al. | 446/135 X |
| 4,878,878 | * | 11/1989 | Bittner | 446/330 X |
| 5,682,692 | * | 11/1997 | Huang | 446/139 X |

FOREIGN PATENT DOCUMENTS

| | | | | |
|---|---|---|---|---|
| 1958938 | * | 11/1979 | (DE) | 446/444 |
| 1106004 | | 12/1955 | (FR) . | |
| 2333410 | * | 7/1977 | (FR) | 446/444 |
| 993099 | * | 5/1965 | (GB) | 446/444 |
| 2 063 084 | * | 6/1981 | (GB) | 446/352 |
| 2063084 | * | 6/1981 | (GB) | 446/352 |

* cited by examiner

*Primary Examiner*—D. Neal Muir
(74) *Attorney, Agent, or Firm*—Woodard, Emhardt, Naughton, Moriarty & McNett

(57) ABSTRACT

The invention relates to a toy having a play base and an article typically depicting a human or animal character which is movable along said play base by manipulation of magnetic or mechanical mechanism which, preferably, are not in direct contact with said article and hidden from view, and said play base includes one or a number of sets which depict an environment such as a shop, park etc and which include objects which are movable by separate magnetic movable or mechanical mechanism contacted by the magnetic or mechanical mechanism to give the effect that the object is moved by the article when it is moved into proximity with the same thereby adding to the impression to a child of the article being independently animated.

17 Claims, 8 Drawing Sheets

TOY WITH MOVING PARTS

REFERENCE TO RELATED APPLICATION

This application is a continuation of U.S. patent application Ser. No. 08/899,175, filed Jul. 23, 1997, now abandoned, and entitled "Toy With Moving Parts", which is hereby incorporated by reference in its entirety.

FIELD OF INVENTION

The invention which is the subject of this application relates to a toy having a play environment for an article thereon and particularly to a toy of relatively small scale wherein a small scale article can be moved around the environment as the child wishes.

BACKGROUND OF THE INVENTION

The provision of environments for articles depicting humans, animals or imaginary figures is well known as being attractive to children. The ability to have moving parts in said environments is also well known although typically the parts are required to be moved by the child and the article is then moved in relation to the parts by the child. The ability to move the parts does add to the childs enjoyment of the toy but does not provide a satisfactory realism to the toy as the child is required to manipulate the movable parts.

In an effort to overcome this problem it is known to have toys with mechanically movable parts however these parts are typically sprung or otherwise actuated and are required to be activated by the child pushing or moving a switch on the toy. Again therefore the parts are only movable by intervention of the child and again the realism of the toy is diluted.

SUMMARY OF THE INVENTION

The aim of the current invention is to provide a toy with an article which can be moved around the environment depicted on the toy without the need for physical contact with the article and to provide the toy with movable objects which move upon actuation by control means for the article thereby creating the effect that the objects are moving independently and/or the article is causing the objects to move and not the child.

The invention in a first aspect comprises a toy, said toy having an article which is movable along a play base, said article movement actuated and controlled by control means and the play base includes mounted thereon at least one movable object and wherein the object is movable when the article is moved into proximity to the same by contact of the control means with actuating means connected to the said object.

In one embodiment the control means and actuating means are provided on the underside of the play base and hidden from view external of the toy such that the actuating contact with the actuating means takes place out of sight.

Typically, in one embodiment, the control means includes a housing in which is provided a magnet which in conjunction with at least one magnet in the article creates a magnetic filed which causes the article to move as the housing is moved. This arrangement is described in detail in the applicant's co-pending application. As the housing moves so it and the actuating means are arranged to contact prior to the article on the upper side of the play base reaching the object to which the actuating means are connected to move.

It is possible that in other embodiments of control means no housing or magnet is provided but in whichever embodiment the control means are provided with a contact means which contacts with the actuating means prior to the article reaching the object to which the actuating means are connected.

In one embodiment when the control means and actuating means are in contact, continued movement of the control means relative to the actuating means can be used to cause continued movement of the object and thereby create a desired movement effect of the object connected to the actuating means.

By providing contact of the control means with the actuating means on the underside of the play base prior to the article reaching the movable object on the upper side of the play base so the visual appearance of the toy in use is that the object has either moved of its own accord or, if the proximity of the article to the object at the instant of movement is relatively close, the appearance can be created that the article has in fact caused the object to move. When one considers that the article can be a scale model of a child or adult the effect of the model moving an object is considerable and greatly increases the realism of the toy to the child playing with same.

The actuating means can typically be of any suitable mechanical arrangement and can include lever arms, gearing arrangements to increase or decrease the effect of the contact and/or relative movement of the actuating means and control means on the movement of the object and resilient biasing members to cause the objects to move back to a particular position when contact between the control means and the actuating means ceases. It should therefore be appreciated that any suitable mechanical arrangement can be provided to suit the characteristic of movement of the particular object to which the actuating means are connected.

In a further embodiment the control means and/or actuating means may include electrical contact means such that when contact is made between the same an electrical effect is created, perhaps visually on the object and/or audibly. In this arrangement the toy will also include a power cell or can be connected to an external electricity supply.

In whichever embodiment it is preferred that the toy include a plurality of movable objects mounted on the play base and said objects can be movable in any direction determined by the actuating means therefore.

BRIEF DESCRIPTION OF THE DRAWINGS

A specific embodiment of the invention will now be described with reference to the accompanying drawings; wherein.

DESCRIPTION OF THE PREFERRED EMBODIMENTS

Figure 1:
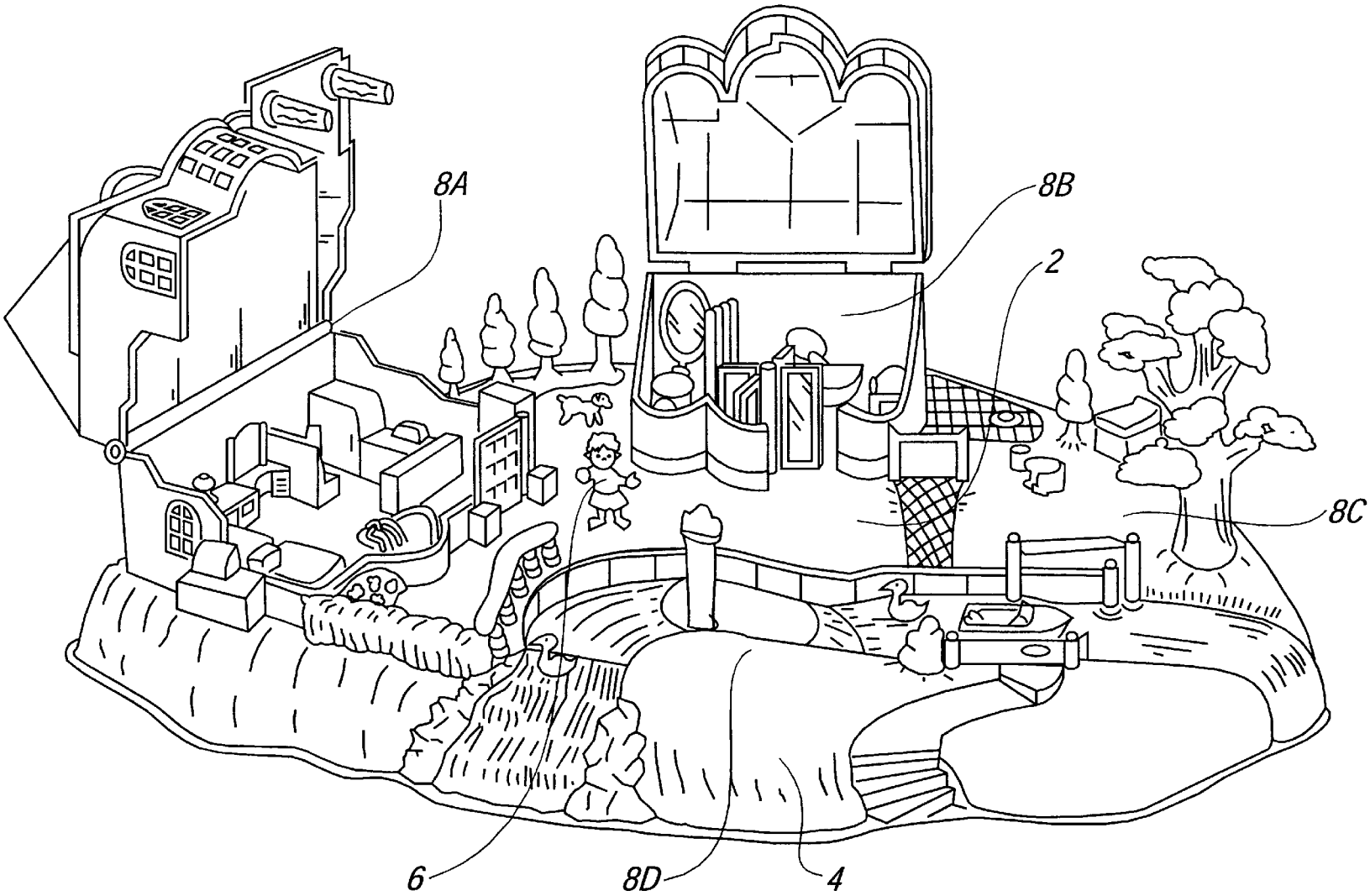
FIG. 1 illustrates a perspective view of an embodiment of the toy v according to the invention.

Referring firstly to FIG. 1 there is illustrated the toy 2 according to the invention, said toy comprising a play base 4 along which an article 6, which in this case is a scale model of a human character, is provided to be moved. On the play base there are provided in fixed relationship thereto, sets 8 which depict specific real life environments such as, for example, a house 8A, shop 8B, park 8C and river 8D which are all environments in which the character depicted and the child playing with the toy would find attractive and interesting. Within and around the various environments 8A–8D are provided a plurality of objects which add to the effectiveness of the environment. At least some of the objects are movable when the article 6 is in proximity thereto and therefore the toy includes an interactive relationship between the article 6 and at least some of the objects and hence an interactive relationship between the child and the toy 2 in that they can make things happen to the article by remote movement of control means.

Figure 2A:
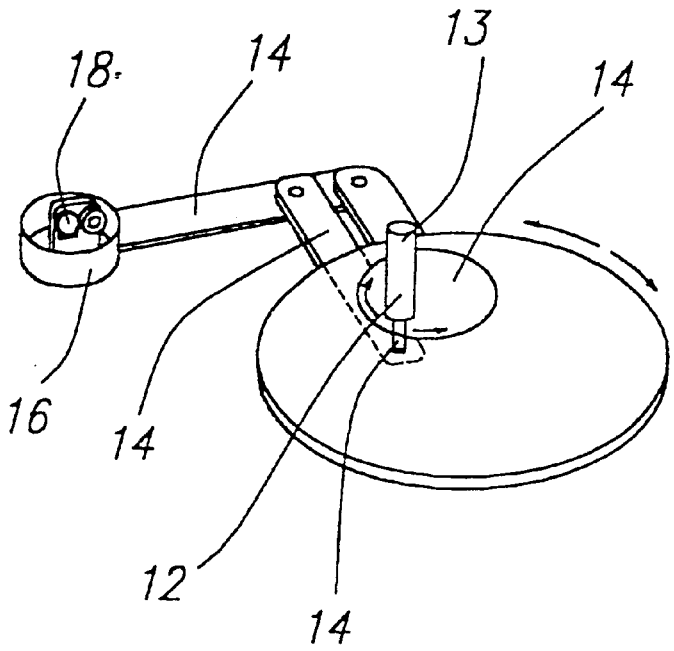
FIG. 2A illustrate one embodiment of control means according to the invention.
Figure 2B:
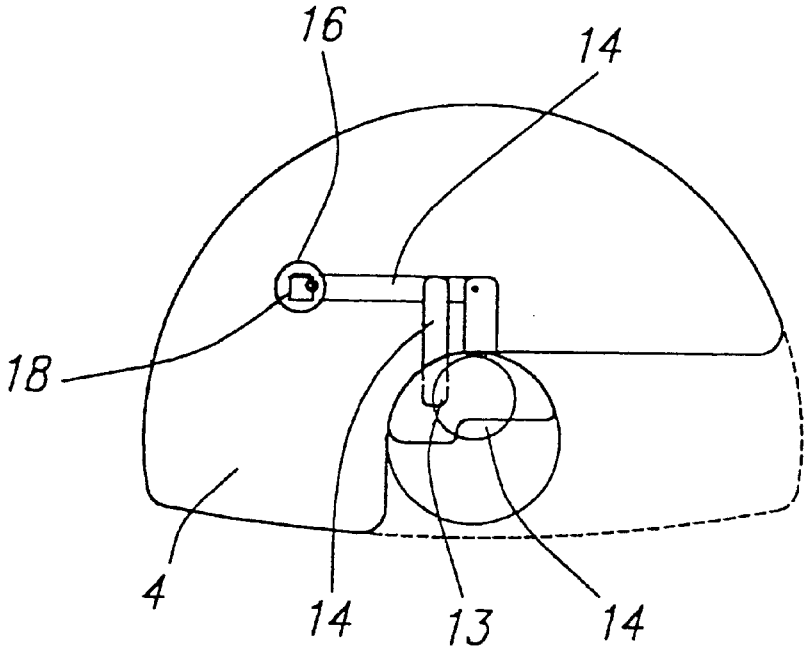
FIG. 2B a view of the control means and underside of the playbase.
Figure 3:
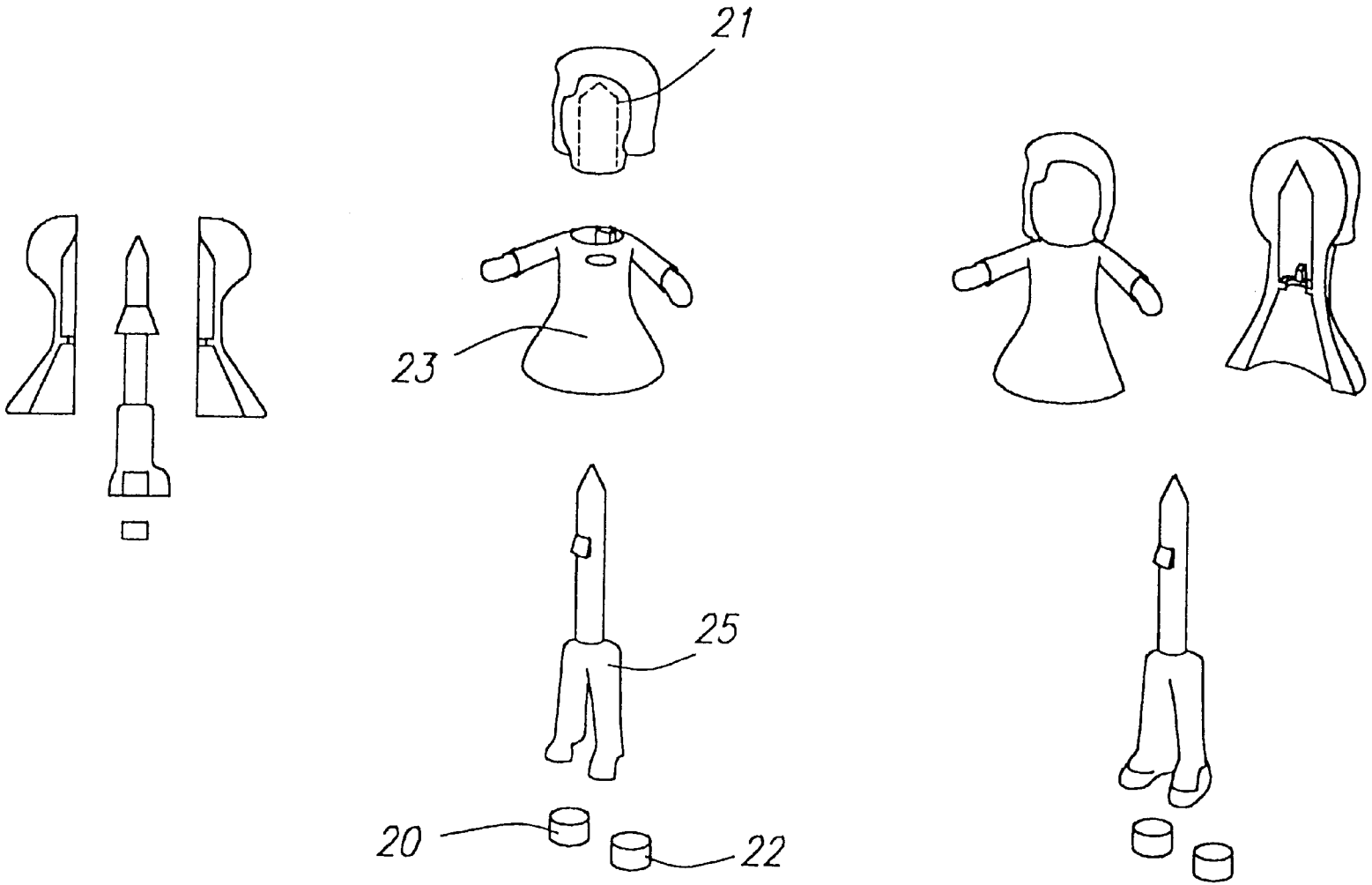
FIG. 3 illustrates one embodiment of an article according to the invention.

All of the above features are provided on the upper side of the play base 4 and are visible to the child. On the underside of the play 2 base and hidden from view are provided control means 12 for control of the movement of the article as shown in FIGS. 2A and 2B wherein the control means comprises a control rod 13 for movement by the child connected to a mechanical arrangement 14 which generates movement of a housing 16 in which is mounted a rotatable magnet 18. The magnet 18 acts in conjunction with magnets 20, 22 in the article 6 the parts of which are shown in FIG. 3 as being head 21, body 23 and legs portion 25, on the upper side of the play base to generate a magnetic field such that as the housing 16 and magnet 18 move under the play base so the article is caused to follow the same and move along the upper side of the play base 4. The operation and relationship of the control means and article are described in more detail in the applicant's co-pending application.

Also provided under the play base are a series of sets of actuating means, each set connected to a movable object on the upper side of the play base and provided to cause movement of the same when the control means housing 16 contact the actuating means. As will be shown with reference to the FIG. 4 which follows, the sets of actuating means can be of different forms and include components to suit the particular direction and/or style and/or speed of movement required and whether or not prolonged contact and/or relative movement of the housing and actuating means is required to provide additional movement characteristics such as a reciprocating action or continued rotational movement.

Figure 4:
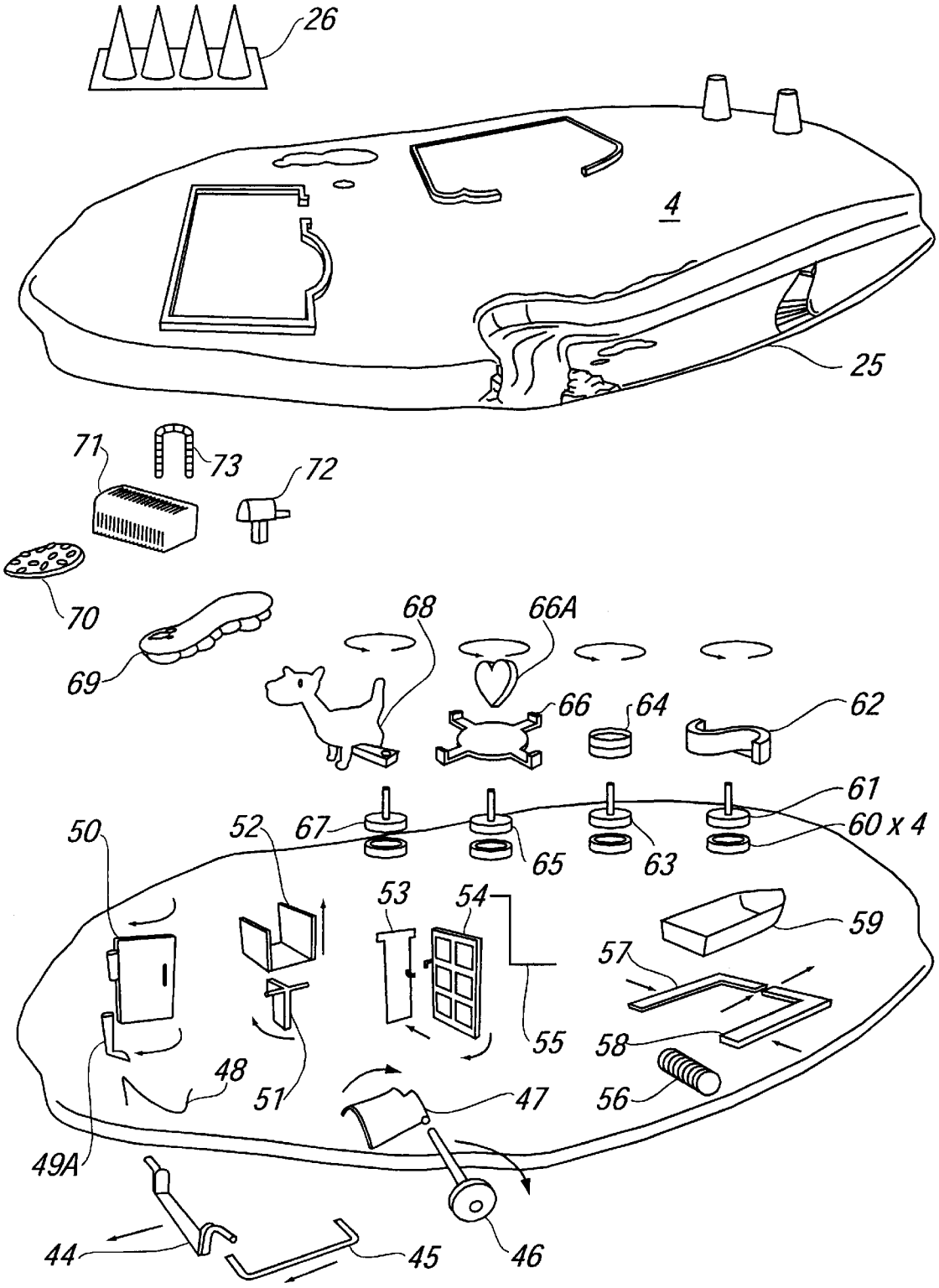
FIG. 4 illustrates an exploded view of the toy in one embodiment illustrating the component parts of the same.
Figure 4:
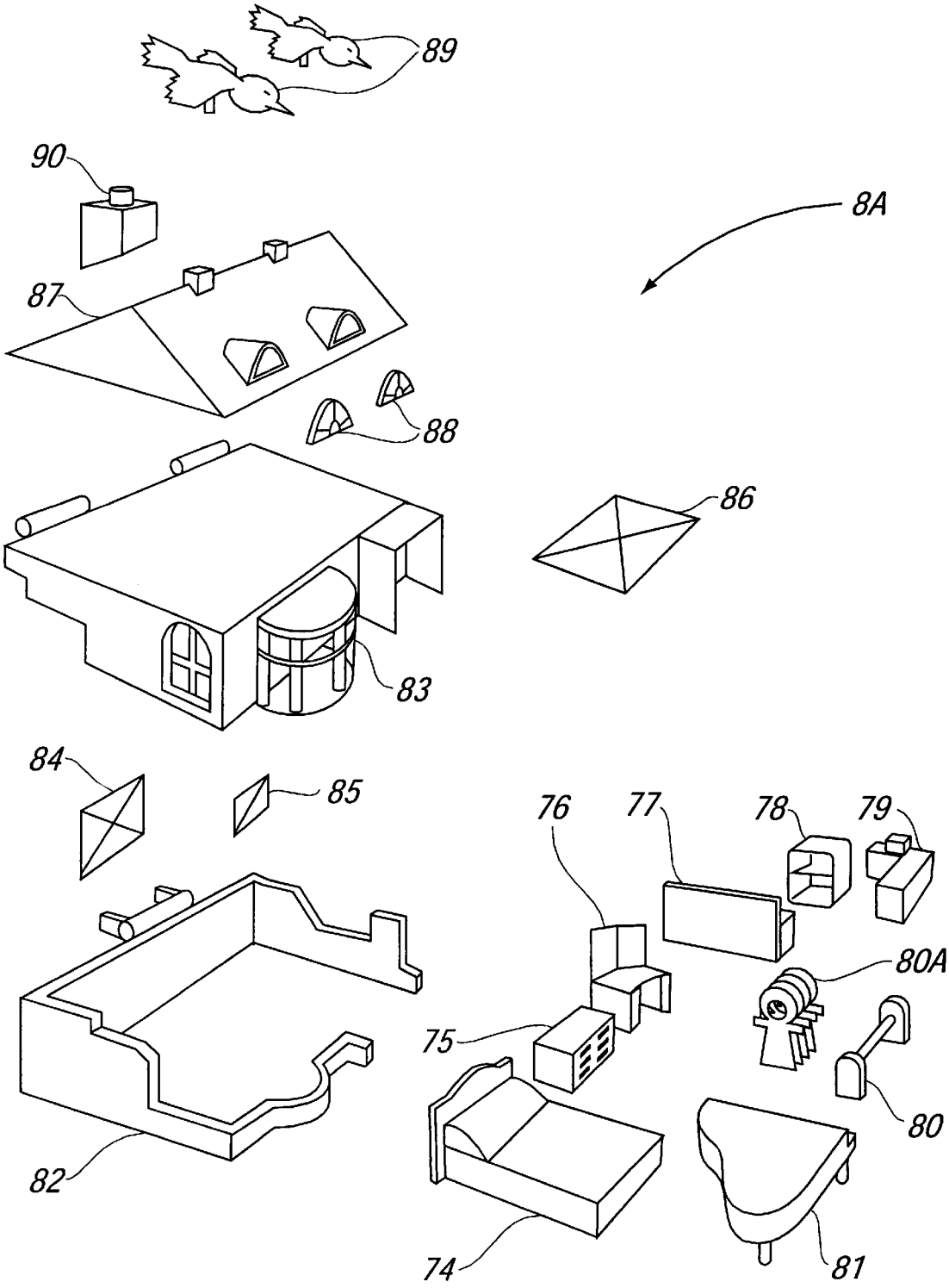
Figure 4:
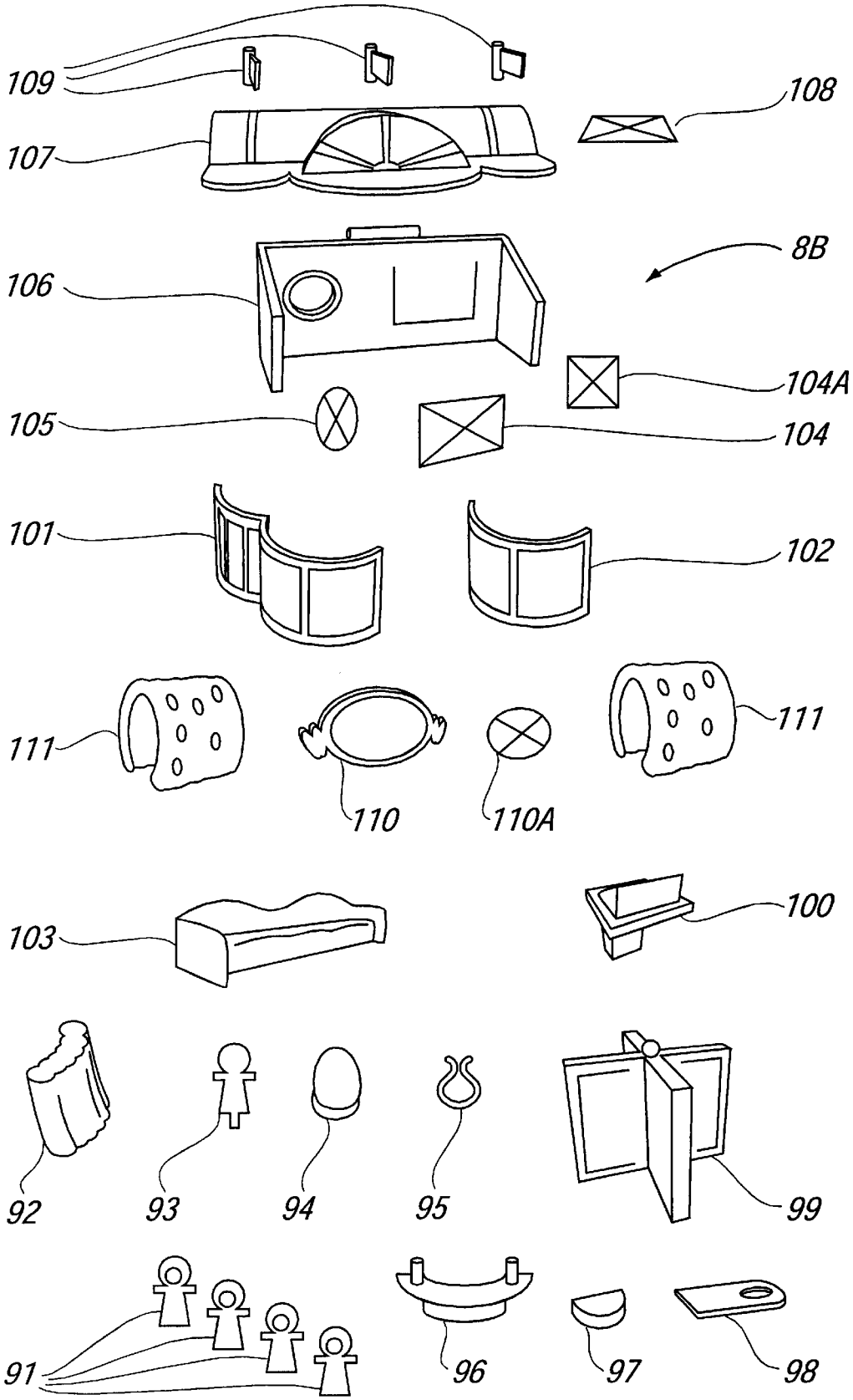
Figure 4:
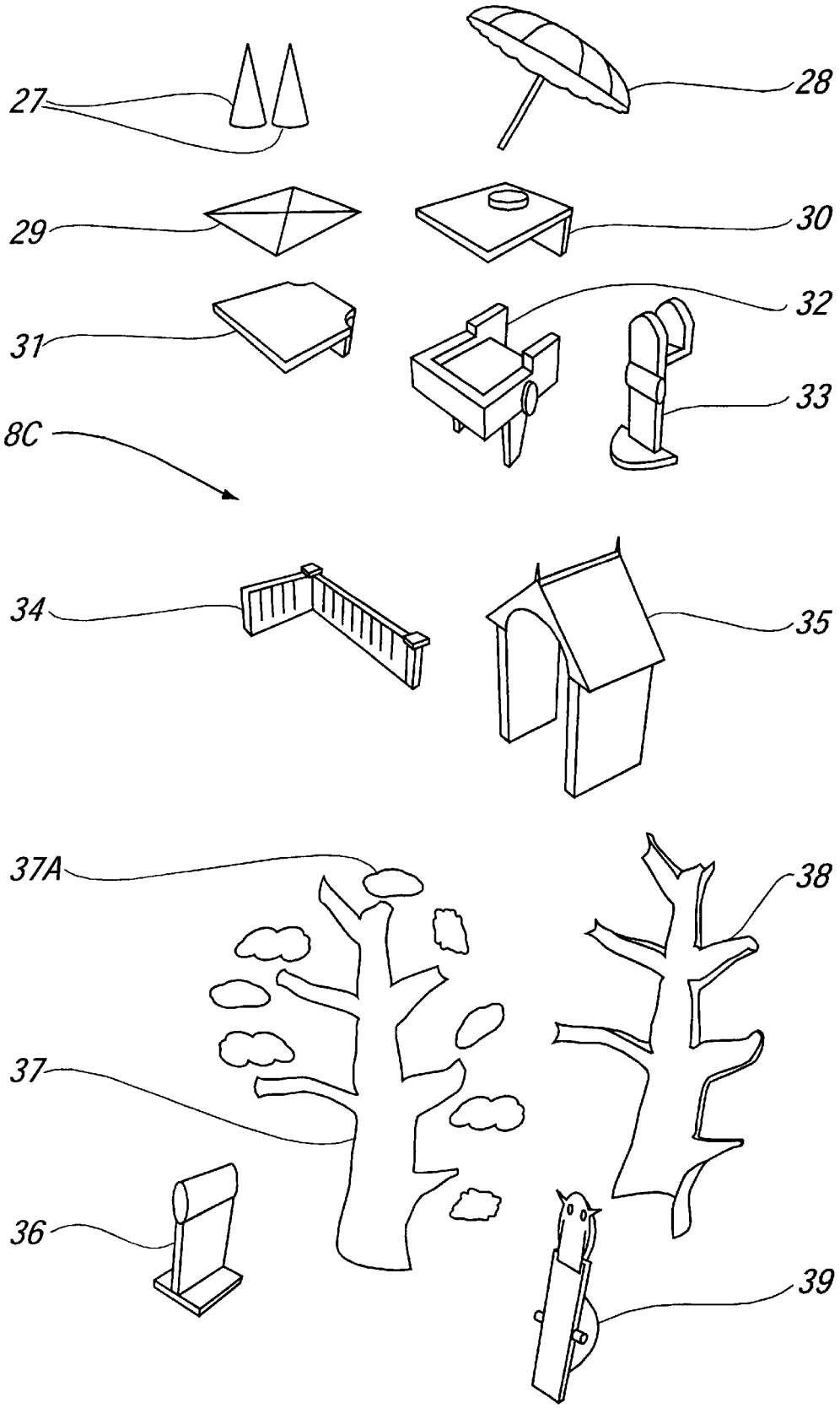
Figure 4:
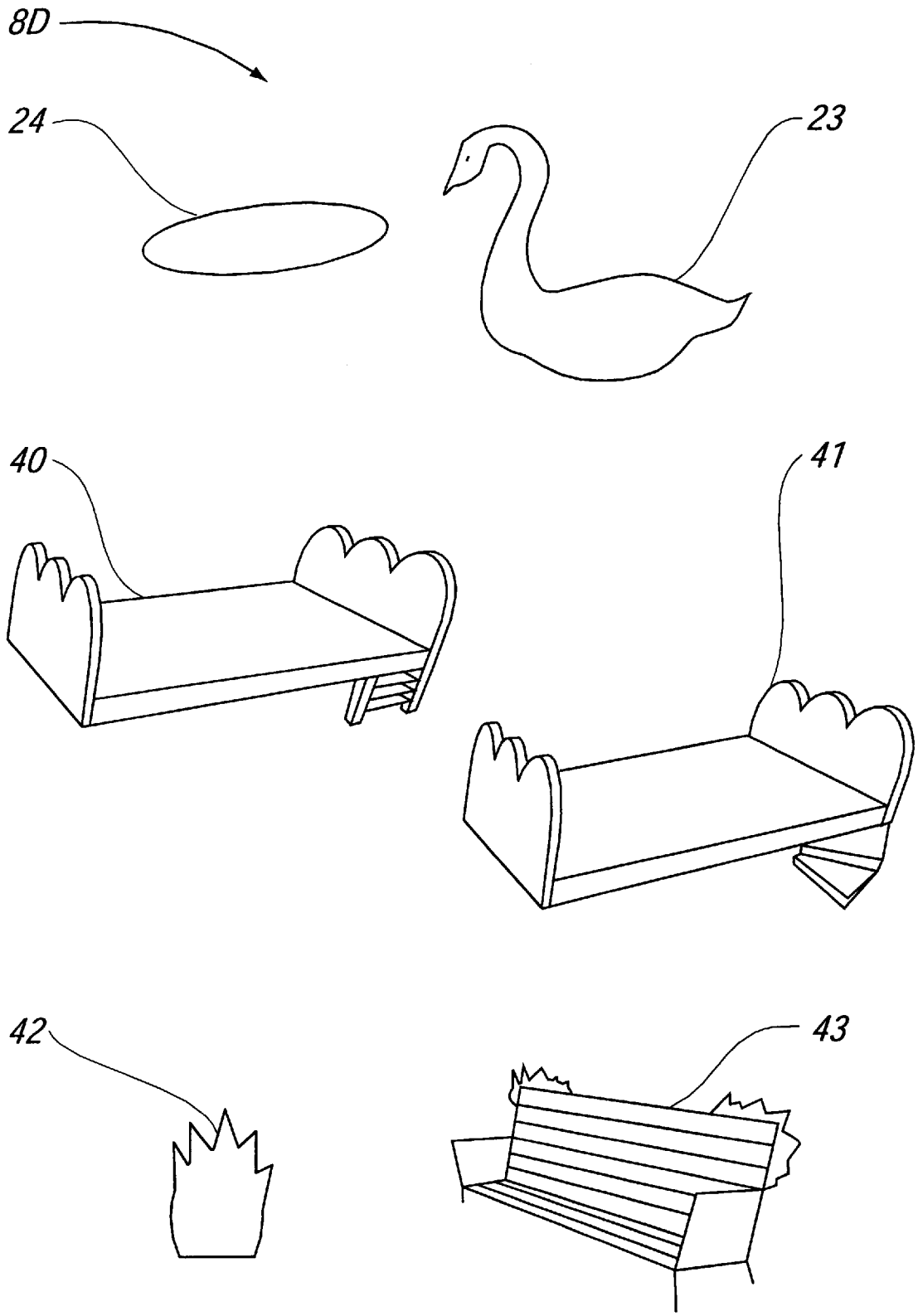

Referring now to FIG. 4 there is illustrated an exploded view of the components of one embodiment of the toy wherein the play base 4 is shown with a skeletal outline formed thereon and the control means are not shown. In the area depicted above the play base are shown the fixed sets and object components 74–90 which form the house set 8A, the components 91–111 which form the shop set 8B, the components 27–39 which form the park set 8C and including movable components 39, 30–33 and the components 23–25 and 40–43 which form the river set 8D. Also shown are further peripheral components 69–73 and 26 which provide additional visual features to the play base.

Turning now to the area below the play base 4 there is shown various objects which are movable and when in position, positioned on the upper surface of the play base 4 and the sets of actuating means therefore. Turning firstly to object 50 this is a door for the house set 8A and is provided to be movable between open and closed positions such that as the article 6 moves toward the same the door opens to allow the article to pass into the house set 8A and can be arranged to close behind the article. The actuating means comprise a lever 49 with a flap 49A with which the housing contacts to cause the door 50 to open. Turning now to objects 68; 66, 66A; 64 and 62 which are in the form of a dog, roundabout, turntable for a clothes rack and seat respectively, all are arranged to be moved in a rotating manner by actuating means which comprise a drive wheel and contact wheel arrangement 67; 65; 63 and 60,61. The speed of rotation can be determined by the ratio of the drive and contact wheels for each arrangement and the rotation is caused by the relative movement of the housing 16 of the control means along the contact wheel thereby causing the drive wheel to drive the object.

Turning to object 59 there is shown a boat for movement in the river area 8C said boat movable between banks of the river by the housing of the control means contacting actuating means 56–58 which comprise a lever arrangement and a biasing means which allow the boat to move across the river and be returned once the article 6 moves away.

Object 47 depicts the cover of a bed 74 for the house set 8C which is hingably movable between a down position when the article 6 is in the bed or the bed is empty and a raised position to allow the article 6 to go into the bed or leave the same. In this case the actuating means 44–48 comprise a lever, hinge mechanism and resilient means to allow the movement of the article to cause the bed cover to not only raise but lower onto the article when the article effectively topples over into the bed when it reaches a stop in the guide means for the housing. The article can also be raised when the housing is caused to move thereby raising, in conjunction with the effect of the magnetic field between the control means and the article, the article from the bed and to a vertical position once more. It will be appreciated that the magnetic field is required to be sufficiently strong to cause the article to be moved from a horizontal to a vertical position and the play base thickness can also be reduced in this area to increase the strength and effect of the magnet on the article in this area.

Turning to objects 29–33 these depict an ice cream stand and in this arrangement are provided with actuating means which cause the lid 31 of the stand to raise when the article moves toward the same. In the case of object 39 this comprises an owl which is movable between a retracted position within a tree 38 and a viewable position by contact of the control means with the lever actuating means to which the owl is connected.

Typically the actuating means and control means are held between the play base 4 and a bottom cover, not shown, which effectively acts to sandwich the control means and the actuating means in position with the play base.

Thus it will be appreciated that the arrangements so described provide an innovative and effective visual effect wherein an article moving along a play base can appear to cause objects to move or indeed objects may move without apparent effort as the article comes into proximity to the same. Furthermore the type of objects which move and the manner in which the same move can be controlled to suit the environment created for the toy and while in the embodiment shown the movement effects created are designed to represent a lifelike environment it is equally possible that the movements created can be non-obvious and unexpected and unexplainable to the child playing with the toy with an environment to suit.

What is claimed is:

1. A toy comprising:

a play base having a top side and an underside;

an article movable in a selected one of a plurality of directions along the top side of the play base, a series of movable objects mounted on the top side of the play base, a series of sets of actuating means for controlling movement of said series of movable objects, said series of sets of actuating means mounted on the underside of the play base, wherein each set of actuating means comprises a different mechanical mechanism for controlling movement of selected objects from said series of movable objects in a different direction relative to the play base or speed relative to other movable objects, and, control means for controlling movement of the article in an operator selected direction during play, said control means mounted on the underside of the play base wherein movement of the control means causes movement of the article which results from an attractive force between the control means and the article extending between the underside and top side of the play base and wherein each actuating means in the series of sets of actuating means is actuated by contact with said control means.

2. A toy according to claim 1 wherein the control means and actuating means are provided on the underside of the play base and hidden from view externally of the toy such that the actuating contact with the actuating means takes place out of sight.

3. A toy according to claim 1 wherein the control means includes a housing in which is provided a magnet which, in conjunction with at least one magnet in the article, creates a magnetic field to provide the attractive force between the article and the control means, which causes the article to move as the housing is moved.

4. A toy according to claim 3 wherein the housing and the actuating means are arranged to contact prior to the article, controlled by the control means, on the upper side of the play base reaching the object to which the actuating means are connected.

5. A toy according to claim 1 wherein the control means is provided with a contact means which contacts with actuating means prior to the article controlled by the control means contacting the object to which the actuating means are connected.

6. A toy according to claim 1 wherein when the control means and actuating means are in contact, continued relative movement of the control means and the actuating means cause continued movement of the object connected with the actuating means and/or article.

7. A toy according to claim 1 wherein the article moved along the play base is in the form of a scale human or animal figure and the scaled objects which are movable on the play base are features of the environment in which the figure depicted is found.

8. A toy according to claim 1 wherein the distance between the contact point of the control means and the position of the article and the position of the actuating means relative to the object are at set to suit the object depicted so as to create a realistic movement effect of the object relative to the article on the upper side of the play base.

9. A toy according to claim 1 wherein the actuating means includes at least one lever arm or at least one gearing portion to increase or decrease the effect of the contact or relative movement of the actuating means or control means or both on the movement of the object.

10. A toy according to claim 1 wherein the toy includes a plurality of movable objects each connected to an actuating means and said objects movable as determined by the actuating means.

11. The toy of claim 1 wherein the mechanical mechanism comprises a lever.

12. The toy of claim 1 wherein the mechanical mechanism comprises a contact wheel or gear.

13. The toy of claim 1 wherein the mechanical mechanism comprises a biasing means.

14. The toy of claim 1 wherein a selected actuating means causes a selected object to pivot in a direction substantially parallel to the play base.

15. The toy of claim 1 wherein a selected actuating means causes a selected object to pivot in a direction substantially perpendicular to the play base.

16. The toy of claim 1 wherein a selected actuating means causes a selected object to rotate in a direction substantially parallel to the play base.

17. The toy of claim 1 wherein a selected actuating means causes a selected object to move across a portion of the top side of the play base.

* * * * *